United States Patent [19]

Frame

[11] 4,376,145

[45] Mar. 8, 1983

[54] ELECTROLUMINESCENT DISPLAY

[75] Inventor: Norman J. Frame, Whitefish Bay, Wis.

[73] Assignee: W. H. Brady Co., Milwaukee, Wis.

[21] Appl. No.: 340,092

[22] Filed: Jan. 18, 1982

Related U.S. Application Data

[63] Continuation of Ser. No. 218,511, Dec. 22, 1980, abandoned.

[51] Int. Cl.[3] ..... G09F 13/22

[52] U.S. Cl. ..... 428/195; 40/544; 428/469; 428/690; 428/698; 428/917

[58] Field of Search ..... 428/913, 195, 469, 690, 428/698, 917; 313/506; 427/66; 40/542, 544

[56] References Cited

U.S. PATENT DOCUMENTS

| | | | |
|---|---|---|---|
| 3,095,324 | 6/1963 | Cusano et al. | 428/913 X |
| 3,984,586 | 10/1976 | Kawarada et al. | 427/66 X |
| 4,095,011 | 6/1978 | Hawrylo et al. | 428/469 |
| 4,173,677 | 11/1979 | Nakano et al. | 428/335 |
| 4,211,813 | 7/1980 | Gravisse et al. | 428/263 |
| 4,215,289 | 7/1980 | DeHair et al. | 428/539 X |

OTHER PUBLICATIONS

Fugate, K. O., *High Display Viewability Provided by Thin-Film EL, Black Layer, and TFT Drive*", *IEEE Transactions on Electron Devices*, vol. ED-24, No. 7, Jul. 1977, pp. 909-917.

Landorf et al., "Sputtered Manganese Dioxide as Counterelectrodes in Thin Film Capacitors", *J. Electrochem. Soc.*, vol. 119, No. 4, Apr. 1972, pp. 430-433.

*Primary Examiner*—Henry F. Epstein

[57] ABSTRACT

An electroluminescent display device is provided in which electroluminescent portions are defined by first laying down a layer of electroluminescent host material and thereafter doping this layer in selected portions with an electroluminescent activator.

3 Claims, 2 Drawing Figures

ELECTROLUMINESCENT DISPLAY

This is a continuation of application Ser. No. 218,511 filed Dec. 22, 1980, now abandoned.

FIELD OF THE INVENTION

This invention relates to electroluminescent displays.

SUMMARY OF THE INVENTION

I have discovered that the electroluminescent portions of an electroluminescent display device may be defined by first laying down a layer of electroluminescent host material and thereafter doping this layer in selected portions with an electroluminescent activator. In a preferred embodiment, the host material is zinc sulfide and the activator is manganese.

PREFERRED EMBODIMENT

Drawings

There is shown:

Description

Turning now to the drawings, there is shown an electroluminescent display indicated generally at 10.

Soda lime glass support 12, ⅛" in thickness, supports transparent conductor layer 14 of electrically conductive SnO2 3,000 Ångstrom units in thickness (deposited by RF sputtering tin in the presence of oxygen). Supported thereon is insulating layer 16 of tantalum pentoxide, 4,000 Ångstrom units in thickness (deposited by RF sputtering of tantalum in the presence of oxygen).

Figure 1:
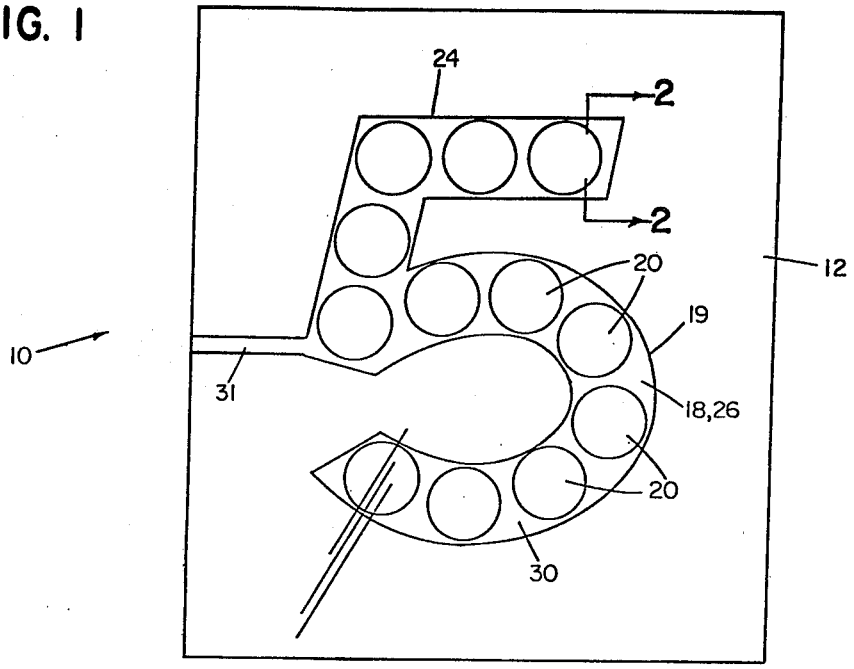
FIG. 1 is a plan view of a preferred embodiment of the invention.
Figure 2:
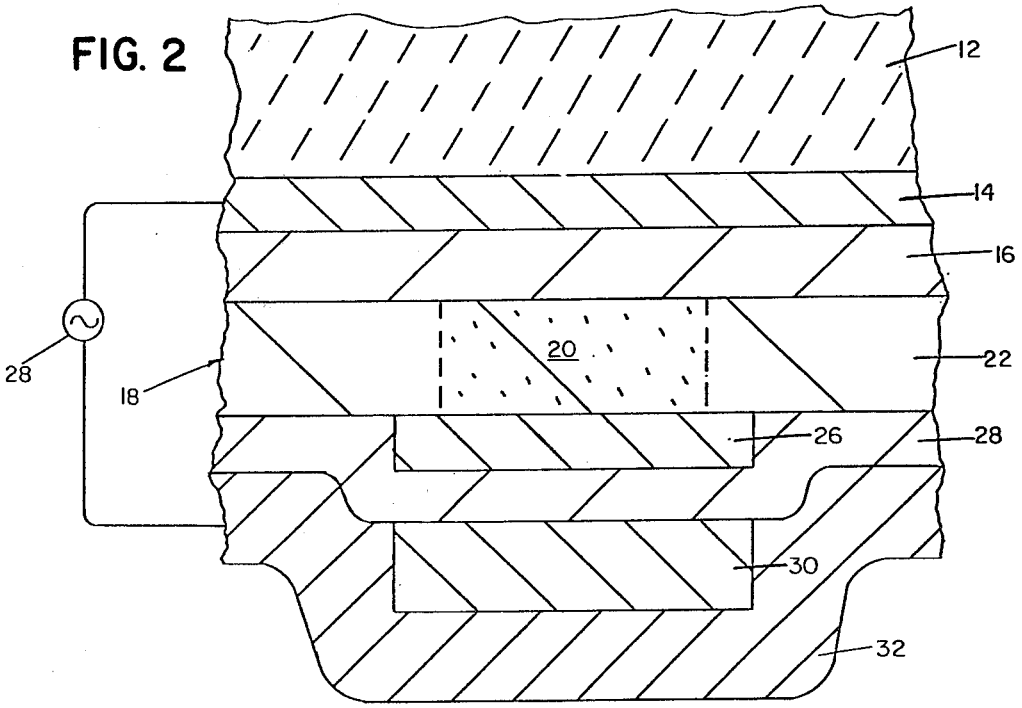
FIG. 2 is an enlarged cross-sectional view taken at 2—2 of FIG. 1.

On layer 16 is more complex layer 18, which includes electroluminescent portion 20 and non-electroluminescent portion 22. Layer 18 is formed by first evaporating zinc sulfide to a thickness of 6,500 Ångstrom units, over the entire area of support 12. Following this, manganese is deposited through a mask to a thickness of 75 Ångstrom units over the round areas 20, as shown in FIG. 1. Thereafter a vacuum is drawn, helium is backfilled to a pressure of 1,000 microns, and temperature is raised to 550° C. for one hour, to diffuse the manganese into zinc sulfide. (Although in the drawing the entire portion 20 is shown within the dotted lines as uniform, it is not known the precise depth to which the diffusion takes place, nor the precise configuration of the zone boundaries.) In this embodiment the zinc sulfide is the host and the manganese is the activator.

On layer 18 is deposited, over the area indicated at 24 in FIG. 1 a convertible semiconductor layer 26 of manganese dioxide 3000 Ångstrom units in thickness (deposited by RF sputtering of manganese, in the presence of oxygen, through a mask). Supported by layers 18 and 26 over the entire area of the device is insulating layer 28 of tantalum pentoxide 4000 Ångstrom units in thickness (deposited by RF sputtering tantalum in the presence of oxygen).

Next is electrode layer 30 of aluminum, deposited over the area 24, but with tail 31 extending therefrom to the exterior for electrical connection through alternator 29 with layer 14.

The device is finished off with a black silastic potting layer 32, for protection and added contrast enhancement.

Operation

In my invention the manganese dioxide layer 26 counteracts the effect of defects such as pinholes in tantalum pentoxide layer 28, as well, I believe, as defects in the layers 16 and 18. The $MnO_2$ layer 26 additionally advantageously provides the advantage of contrast enhancement.

The invention technique of defining of electroluminescent zones permits the achievement of complex and interesting display patterns, all activatable by the single electrode 30, so that the zones 20 become luminescent when the electrical source 29 is activated.

OTHER EMBODIMENTS

Other techniques for forming layers may of course be used. Other materials may be used. For example SiO may be used as an insulating layer. Although yet untested, it is believed that reversal of deposits of the layer 26 and 28, to eliminate the step in the latter, may be the most preferred embodiment.

What is claimed is:

1. An electroluminescent display device comprising a layer of electroluminescent host material such as zinc sulfide, selected portions of said host material being activated with an electroluminescent activator such as manganese, said selected portions being transversely separated from one another by unactivated portions of said host material, and said selected portions defining a desired display pattern, and an electrode extending transversely over a plurality of said selected portions in order that said plurality may be illuminated by activation of said electrode.

2. The device of claim 1 in which said host material is zinc sulfide and said activator is manganese.

3. The electroluminescent display device of claim 1 wherein said selected activated portions have been activated by depositing the activator through a mask and thereafter heating the device sufficiently to diffuse the activator into the host material.

* * * * *